United States Patent [19]

Jones

[11] Patent Number: 4,488,703

[45] Date of Patent: Dec. 18, 1984

[54] VALVE APPARATUS

[75] Inventor: Marvin R. Jones, 414 Flintdale, Houston, Tex. 77024

[73] Assignee: Marvin R. Jones, Houston, Tex.

[21] Appl. No.: 467,596

[22] Filed: Feb. 18, 1983

[51] Int. Cl.[3] ..... F16K 3/314

[52] U.S. Cl. ..... 251/77; 251/1 A; 92/DIG. 4

[58] Field of Search ..... 251/77, 78, 1 R, 1 A; 92/DIG. 4, 129

[56] References Cited

U.S. PATENT DOCUMENTS

| | | | |
|---|---|---|---|
| 777,373 | 12/1904 | Howard | 251/77 |
| 916,831 | 3/1909 | Bettinger | 251/77 X |
| 1,713,364 | 5/1929 | Arbon | 251/1 A X |
| 2,146,470 | 2/1939 | Grantham et al. | 251/1 A |
| 2,241,747 | 5/1941 | Shaw | 251/77 |
| 3,036,807 | 5/1962 | Lucky et al. | 251/28 |
| 4,054,156 | 10/1977 | Benson | 137/630 |
| 4,253,638 | 3/1981 | Troxell, Jr. | 251/1 A |

FOREIGN PATENT DOCUMENTS

| | | | |
|---|---|---|---|
| 1352258 | 5/1974 | United Kingdom | 251/1 A |

*Primary Examiner*—James C. Yeung
*Assistant Examiner*—Allen J. Flanigan
*Attorney, Agent, or Firm*—Vaden, Eickenroht, Thompson, Bednar & Jamison

[57] ABSTRACT

There is disclosed a blowout preventer having rams which are moved between opened and closed positions by means of operating systems having axially reciprocable rods releasably connected to the rams for relative axial movement with respect thereto. The connections between the rams and rods fixedly support the rams against tilting, during repair or replacement, regardless of the relative axial position of the rods and rams.

27 Claims, 6 Drawing Figures

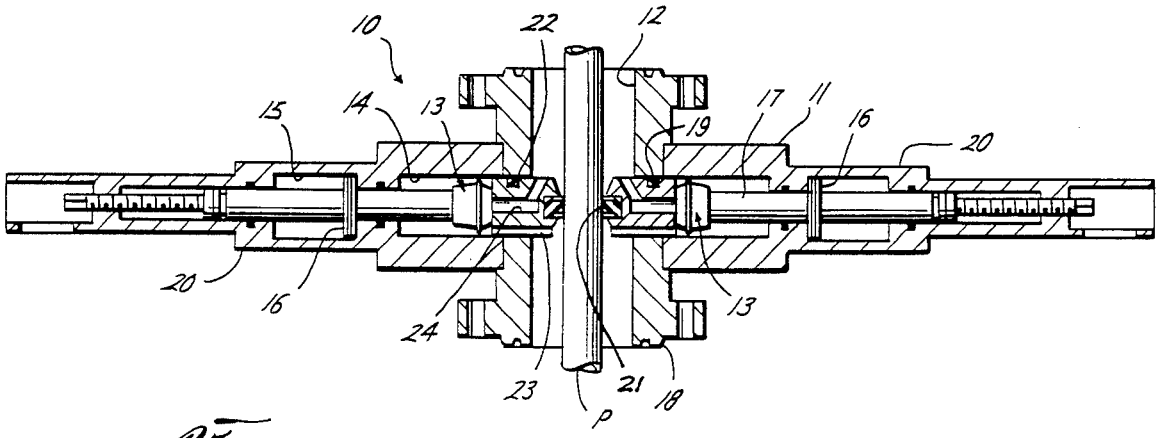
Fig. 1
Fig. 5
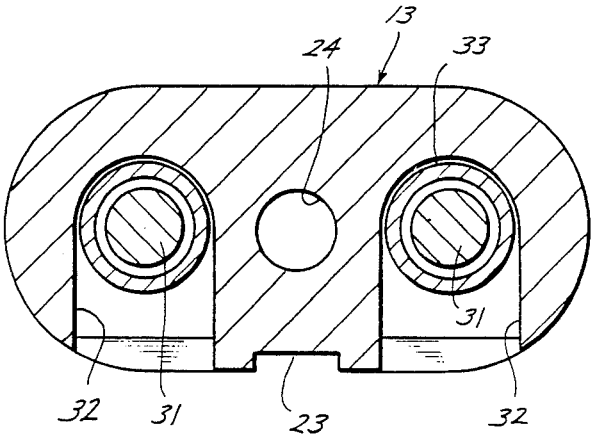
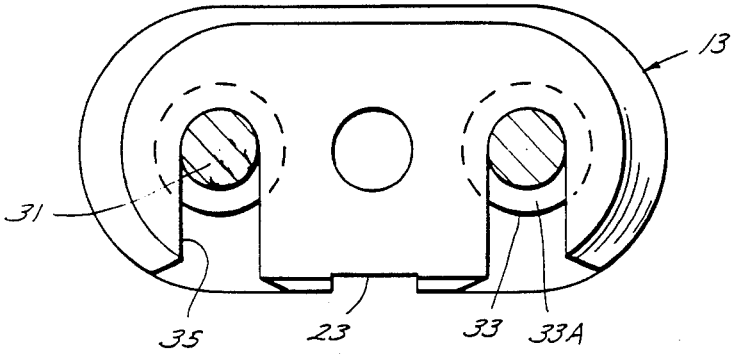
Fig. 6

VALVE APPARATUS

This invention relates in general to valve apparatus such as a blowout preventer having opposed rams each of which is connected to the inner end of an axially reciprocating rod of an operating system for movement between positions opening and closing a bore through the preventer housing. More particularly, it relates to improvements in apparatus of this type wherein each ram or other closure member is connected to its rod by means of studs or enlarged parts on pins at the inner ends of the rod which are received closely within slots extending upwardly from the bottom of the ram, so that the inward and outward movement of the rods is transmitted to the rams, when they are so connected, but which permit the rams to be lifted from and lowered into connection with the rods upon movement of the rams out of the chambers of the housing in which they reciprocate. In one of its novel aspects, this invention relates to blowout preventers of this type wherein well fluid within the bore of the housing beneath the rams when closed is permitted to pass into the ram chambers behind the closed rams, and thereby provide a force which supplements that of the operating system in maintaining the rams closed.

During movement of the rams between opened and closed positions, the pins at the inner ends of the rods are not required to support their weight, but merely to transmit the axial force of the operating system which reciprocates them within their chambers as they are moved between opened and closed positions. However, when the bonnets containing the operating system for each ram are moved to open positions to permit the rams to be moved out of the chambers, and thus positioned for replacement or repair, the upper ends of the slots in the rams move downwardly a short distance into supported positions on the pins of the rods. In a conventional blowout preventer of this type, the close fit of the studs on the inner ends of the pins within the slots prevents the rams from tilting or canting, despite their considerable size and weight, and thus enables them to be moved back into the guideways, upon closing of the bonnets, without extraneous lifting apparatus.

The force due to well fluid behind the closed rams, although useful in maintaining them closed, increases the power requirements of the operating system to open the rams. Hence, it has been proposed to vent well fluid to the bore of the preventer housing above the closed rams in response to actuation of the operating system to open the rams. Thus, in the preventer shown in copending application Ser. No. 337,383, filed January 6, and entitled "Hydraulically Operated Valves", the rams are connected to the control rods of the operating system by means which permits lost axial motion between them, whereby a packing carried by the rod intermediate the pins may be moved inwardly to close the outer end of a passageway in the ram, as the rod moves inwardly to close the ram, and outwardly to open the outer end of the passageway, as the rod moves outwardly to open the ram.

As also shown in my copending application, in order to permit this relative axial movement between the inner ends of the control rods and the rams, the slots in the rams are enlarged in an axial direction in order to receive the ends of the pins in all axial positions of the rods with respect to the ram. It was found, however, that when the bonnets were moved to open position to permit the rams to be removed from their chambers for replacement or repair, this loose connection permitted the inner ends of the rams to sag with respect to the rods. As a result, it was necessary to lift the inner ends of the repaired or replaced rams into positions in which they might be moved back into the guideways of the main body of the preventer housing as the bonnets were returned to closed position.

It is therefore the primary purpose of this invention to provide a blowout preventer or other valve apparatus of the type above described in which the rams or other closure members are connected to their control rods in such a manner as to permit the necessary relative axial movement between them, but nevertheless firmly support the repaired or replacement rams against sagging or otherwise moving out of positions in which they may be moved easily back into the guideways.

This and other objects are accomplished, in accordance with the illustrated embodiment of the present invention, by a blowout preventer of the type described wherein a bearing ring fits closely about a pin at the inner end of each rod permit relative axial movement between them, and the ring has inner and outer sides adapted to fit closely within inner and outer sides of a slot in the ram, so that when the rod is in an outer axial position with respect to its rod, as, for example, when the ram is withdrawn to open position, it may be lowered into or raised from connection with the rod. More particularly, the ram is recessed to receive the inner end of the rod upon movement to its inner axial positions with respect to the ram, as, for example, in closing the ram. Due to this close fit of the rings about the pin, as well as the close fit of the sides of the ring within its slot, the ram will be supported against sagging regardless of the relative axial position of the rod with respect to the bearing ring, and thus regardless of the axial position of the rams with respect to the control rod, whereby the repaired or replacement rams may be moved easily back into the guideways in the preventer housing.

In the illustrated and preferred embodiment of the invention, a pair of slots are formed in each ram on opposite sides of each axis of reciprocation, and there are a pair of pins at the inner end of each rod for fitting within the slots. Also, each pin has a shoulder which is engageable with a shoulder on the bearing ring thereabout when the rod is moved to its outer position with respect to the ring, so that outward movement of the rod is transmitted to the ram. Also, the rod has means thereon which is engageable with the ram, when the rod is moved to its inner positions, in order to transmit inward movement of the rod to the ram.

As previously described, this invention has particular utility in the connection of rams of the type having passageways therethrough which connect at their outer ends with the chamber behind the rams, and which are opened and closed during opening and closing movement of the rams by a packing carried on the control rod for the ram. Thus, in the illustrated embodiment of the invention, the packing moves into engagement with the outer end of the ram in surrounding relation to the outer end of the passageway as the rod is moved to its inner positions with respect to the ram.

In the drawings, wherein like reference characters are used throughout to designate like parts:

FIG. 1 is a vertical sectional view of a blowout preventer having rams releasably connected to the inner ends of control rods in accordance with an illustrative embodiment of the present invention, and showing the rams in closed position;

Figures 2, 3, 4:
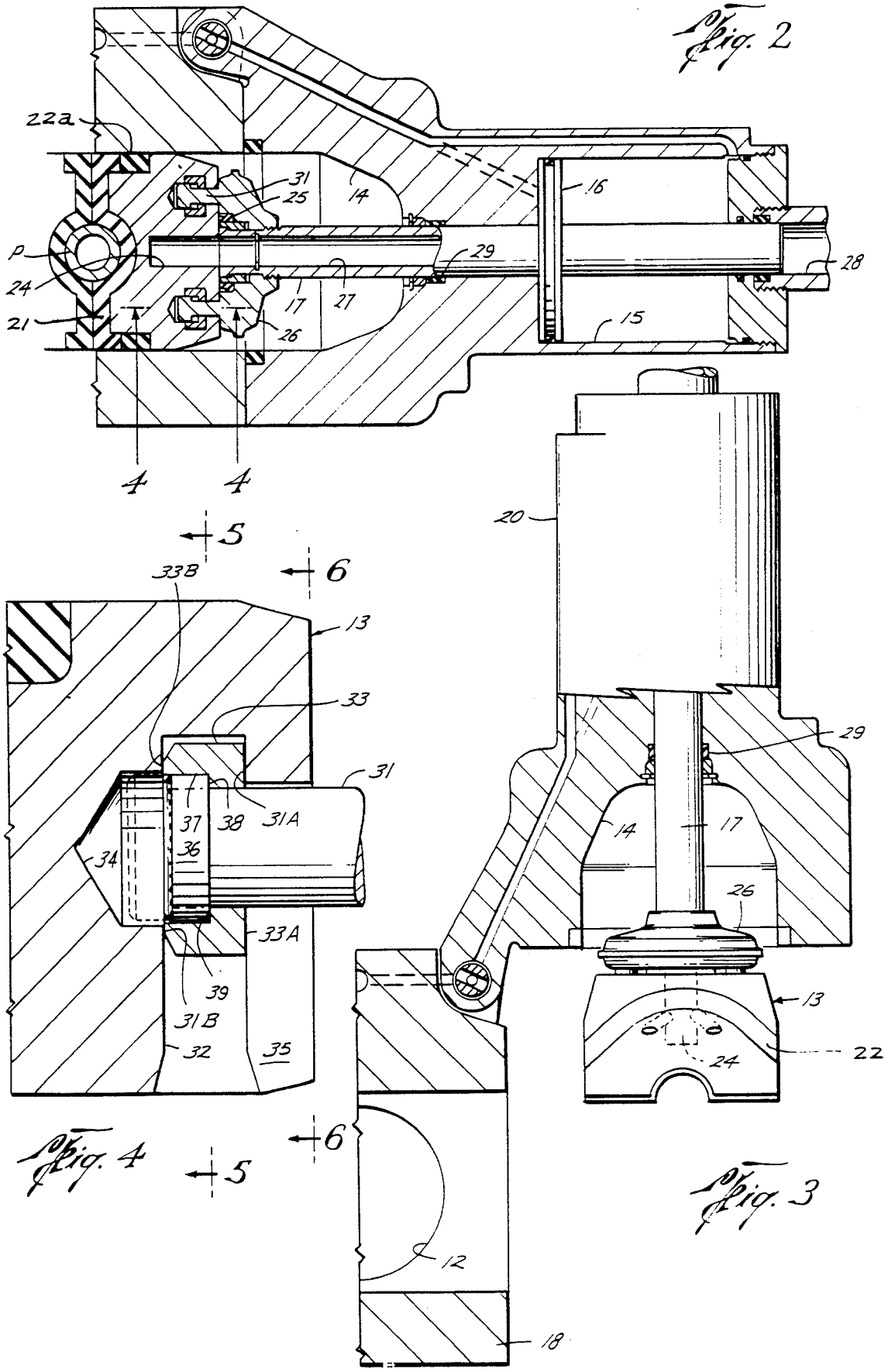
FIG. 2 is an enlarged horizontal sectional view of a portion of the right-hand side of the preventer of FIG. 1, and showing the releaseable connection of the right-hand ram to the inner end of the right-hand control rod.
FIG. 3 is a view similar to FIG. 2, but following retraction of the ram to its open position to permit the bonnet in which the operating system and rod are carried to be swung to the open position, and the ram to be then moved out of its chamber in the bonnet to permit its replacement or repair.

FIG. 4 is a vertical sectional view of the rear portion of the right-hand ram, as seen along broken lines 4—4 of FIG. 2, and showing a bearing ring about the inner end of one of the pins on the control rod fitting closely within a slot in the ram, the pin being shown in solid lines in the outer axial position it occupies when the rod is moved outwardly with respect to the ram in order to open a passageway in the ram and move the ram to open position, and in broken lines in the inner axial position it occupies when the rod is moved inwardly to close the passageway and move the ram to closed position; and FIGS. 5 and 6 are vertical sectional views of the right-hand ram and pins, FIG. 5 being taken along broken lines 5—5 of FIG. 4 and FIG. 6 being taken along broken line 6—6 of FIG. 4.

With reference now to the details of the above-described drawings, the blowout preventer shown in FIG. 1, and indicated in its entirety by reference character 10, comprises a housing 11 having a vertical bore 12 therethrough and adapted to be mounted on a wellhead, which may be at an underwater location. When the preventer is so mounted, a pipe P such as a drill string may extend vertically and generally coaxially through the bore from above water level into the well bore beneath the wellhead. In the drilling of the well, drilling fluid may be circulated downwardly through the drill string P and the bit on its lower end, and upwardly within the annulus between the drill string and the bore 12.

The preventer includes a pair of rams 13 received within chambers 14 in the housing 11 intersecting opposite sides of the bore 12 for movement between outer positions in which they are withdrawn from the bore to open the annulus between the pipe and bore, and inner positions in which, as shown in FIG. 1, their inner ends engage about the pipe as well as with one another to close off the annulus. Each ram is so moved by means of an operating system which includes a cylinder 15 in the housing outwardly of the ram chamber 14, piston 16 axially reciprocable within the cylinder, and a rod 17 on the inner side of the piston which extends through the inner end of the cylinder and into the chamber for releasable connection to the ram. Thus, the ram is moved to closed position as operating fluid is supplied to the outer side of the piston and exhausted from the inner side thereof, or to its outer position upon the supply of operating fluid to the inner side of the piston and exhaustion thereof from the outer side of the piston.

The preventer housing 11 comprises a central body 18 in which the bore 12 is formed and having flanges on its upper and lower ends for connection in the wellhead. Guideways 19 are formed in the control body at the inner ends of the ram chambers. The outer ends of the chambers as well as the operating system including the cylinders 15 are formed within bonnets 20. As shown in FIGS. 2 and 3, each bonnet is pivotally connected to the central body 18 of the housing for swinging between the closed position of FIG. 2 in which the outer end of the ram chamber forms a continuation of the guideway 19 to enable the ram to be moved therein, and the open position of FIG. 3 in which the outer end of the chamber is disposed to one side of the guideway in the central body of the housing to remove the ram connected to the operating system from its guideway.

As well known in the art, in order to move the bonnet to its open position, the piston of the operating system is first actuated to withdraw the ram into the outer end of the ram chamber so that the ram does not interfere with swinging of the bonnet from closed to open position. The piston of the operating system is then moved inwardly to move the ram out of the outer end of the chamber 14 and thus in a position in which it may be raised from connection with the inner end of the rod 17, and thus replaced or repaired in a manner to be described in more detail to follow. Alternatively, of course, the bonnets may be mounted on the main body of the housing for reciprocation between opened and closed positions.

Each ram comprises a metallic ram body of oval cross section corresponding to that of its guideway 19 in order to slide closely therein. The ram body carries packing of rubber-like material to enable the inner ends of the rams to seal about the pipe as well as with respect to each other, and the sides and top sides of the rams to seal with respect to the guideway to form a continuous seal for closing the annulus when the rams are moved to closed position. Thus, the packing includes a front face portion 21 having a vertical recess therein for fitting about the pipe when the rams are moved inwardly to closed position, a top packing 22 extending across the top of the ram to seal with respect to the guideway, when the rams are moved to closed position, and additional packing 22A extending along opposite sides of the rams to connect the top packing with opposite ends of the front packing. It will be understood of course that the rams may instead be "blind" rams for closing an open bore 12 within the preventer housing, in which case the ram front packings 21 would not be recessed but would instead extend straight across from one end to the other.

A groove 23 is formed in the bottom of each ram body to connect its inner end with its outer end, and thus connect the bore 12 beneath front packing 21 with the chamber 14 behind the rams when closed. Thus, when the rams are moved to closed position, the relatively high pressure of well fluid beneath them is effective over a portion of the outer end of the rams to supplement the force of the operating system in maintaining the rams in closed position. However, as previously mentioned, although this force is useful in maintaining the rams closed, it nevertheless increases the requirements of the operating system in opening the rams. Consequently, the rams and the control rods are so constructed as to vent well fluid behind the closed rams to the bore 12 above them automatically upon actuation of the operating system to open the rams.

For this purpose, a passageway 24 is formed in each ram body to connect its outer end with its upper inner portion circumscribed within the front, side and top packing portions thereof. When the rams are moved to closed position, the outer end of the passageway is closed by annular packing 25 on a laterally extending head 26 on the inner end of the control rod 17, but when the operating system is reversed to withdraw the rams, packing 25 is withdrawn from the outer end of the ram to open the passageway and thus vent well fluid from within the chamber 14 in order to facilite withdrawal of the rams.

As also disclosed in the aforementioned copending application, control rod 17 has a hole 27 therethrough connecting at its inner end with the inner end of head 26 within packing 25 and at its outer end with a balance chamber 28 on the outer end of the bonnet outwardly of the cylinder 15 therein. More particularly, the hollow rod extends through an inner packer 29 carried by the bonnet of the cylinder and the ram chamber 14, and an outer packing 30 carried by the outer cylinder head of the bonnet. When the inner diameters of these seal rings are approximately equal, the rod is of course substantially pressure balanced, so as to substantially negate any force to be overcome due to well fluid in the ram chamber as the ram is moved inwardly toward closed position.

As previously described, and as shown in the drawings, the ram connecting means of the present invention includes a pair of pins 31 extending inwardly from the head 26 of the control rod on opposite sides of the hole 27, and thus on opposite sides of the axis of reciprocation of the ram, and a pair of slots 32 extending upwardly from the bottom side of the ram and in longitudinal alignment with the pins when the ram is disposed within the guideway of its chamber 14. More particularly, a bearing ring 33 fits closely about each rod 31 for relative axial movement with respect to it and has outer and inner sides 33A and 33B which are adapted to fit closely within the outer and inner sides 31A and 31B, respectively, of each slot.

Thus, when the sides of the ring are received between the sides of the ram slot, each pin 31 is free to move axially with respect to the ram, and thus with respect to the bearing ring 33 about the pin, between an outer position in which its end is substantially flush with the inner side 33B of the bearing ring, as shown in solid lines in FIG. 4, and an inner position in which it is received within a recess 34 formed in the ram body generally opposite the upper end of the slot, as shown in broken lines in FIG. 4. When the pins are in their outer axial positions, the ram is free to be lowered into or raised from connection with the rod. On the other hand, the recesses 34 permit the pins 31 to be moved axially between their inner and outer positions, and thus permit axial movement of the rod with respect to the ram as the ram is moved between opened and closed positions, and of course as the packing 25 on the inner end of the head 26 of the rod is moved between positions opening and closing the outer end of passageway 24.

The portion of each pin 31 adjacent its end is received within a secondary slot 35 extending upwardly from the bottom side of the ram adjacent the inner side of the slot 31. The vertical centerlines of the primary and secondary slots are substantially axially aligned with one another so that the upper end of each bearing ring may be received within the upper arcuate end of the primary slot, and the upper side of each pin may be received within the upper arcuate end of the secondary slot. As shown in FIG. 4, during movement of the ram within the guideway of the ram chamber 14, the upper ends of the secondary slots 35 are above the pins 31 and the upper ends of the slots 31 are above the bearing rings 33, so that the weight of the ram is not supported by the pins on the control rod. Thus, during normal operation of the preventer, the weight of the rams is instead supported by the guideways and the control rods and their connections to the rams merely guide the rams for movement in axial directions.

Each pin 31 has a flange 36 on its inner end which fits closely within a counterbore 37 in the outer end of the inner diameter of the bearing ring. The flange is no wider than the counterbore so that when the rod is in its inner position axially of the ring, as shown in FIG. 4, the inner side of the flange is substantially flush with the inner side 31B of the slot, and in any event does not protrude from the counterbore. When the rod is positioned, a shoulder 38 on the outer side of the flange 36 engages a shoulder 39 of the bearing ring at the outer end of the counterbore so as to transmit the outward movement of the rod to the ram in order to withdraw the ram to its open position within the ram chamber. As previously described, during the initial opening movement of the control rod to withdraw the pins from their inner to their outer positions, packing 25 is withdrawn from engagement with the inner end of the ram about the passageway 24 so as to vent well fluid behind the ram within the ram chamber to the bore 12 of the preventer housing above the closed rams.

When the control rod is moved inwardly to move the ram to closed position, the flange 36 will move out of the counterbore 37 and into the recess 34 in the ram, as shown in broken lines in FIG. 4. At this time, the packing 35 on the head 26 of the control rod moves into seating engagement with the end of the ram to close the passageway 22, and, as the rod continues to move inwardly, it moves the ram inwardly with it to closed position.

When a ram is to be repaired or replaced, the operating system is actuated to withdraw the ram to its open position, assuming that it is not already in that position, and thus permit the bonnet to be swung to the open position shown in FIG. 3. With the bonnet is opened, the operating system may then be reversed to move the ram out of the outer end of the ram chamber 14 formed in the bonnet. The ram may then be moved inwardly with respect to the valve head 26 so as to dispose the pins 31 in their outer positions with respect to the bearing rings, as shown by solid lines in FIG. 4, and thus permit the ram to be lifted from the ends of the pins.

As the repaired or replacement ram is then moved back over the ends of the pins, the upper ends of the secondary slots in the rams will move into supported positions on the upper sides of the pins 31. When the ram is so positioned, it is held securely against sagging by virtue of the close fit of the bearing rings about the pins, as well as the close fit of the inner and outer sides of the pins within the inner and outer sides of the primary slots. Consequently, upon reverse actuation of the operating system, the rams may be withdrawn back into the outer ends of the ram chambers 14 of the bonnets, and the bonnets swung back to closed positions to dispose the rams in position for movement easily into the guideways of the inner ends of the chambers upon resumption of normal operation of the preventer.

The outer end edges of the rams are chamfered to facilitate their withdrawal back into the outer ends of the ram chambers within the bonnets. The lower ends of the inner and outer sides of the slots 31 are also tapered to guide the rams over the bearing rings on the pins. For this same purpose the outer peripheral edges of the inner sides of the bearing rings are also chamfered.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A blowout preventer, comprising a housing having a bore therethrough and chambers therein which intersect opposite sides of the bore, rams reciprocable within the chambers between outer positions to open the bore and inner positions sealably engaged with one another and the chambers to close the bore, and means for moving each of said rams between its opened and closed positions, including an axially reciprocable rod extending into the ram chamber, and means connecting the rod to the ram for limited axial movement with respect thereto, comprising a slot extending upwardly from the bottom of the ram, a pin on the inner end of the rod, and a bearing ring fitting closely about the inner end of the pin for relative axial movement with respect thereto, said ring having inner and outer sides adapted to fit closely within inner and outer sides of the slot to permit the ram to be lowered into or raised from connection with the rod when the rod is in its outer axial position with respect to said ram, and the inner side of the slot in said ram being recessed to receive the inner end of the pin when the rod is moved to its inner axial position with respect to said ram.

2. A preventer of the character defined in claim 1, wherein the inner end of the pin has a shoulder engageable with a shoulder on the bearing ring thereabout, when the rod is moved to its outer axial position with respect to the ram, in order to transmit outward movement of the rod to the ram.

3. A preventer of the character defined in claim 1, wherein the rod has means thereon engageable with the ram, as the rod is moved to its inner axial position, in order to transmit inward movement of the rod to the ram.

4. A preventer of the character defined in claim 1, including means connecting the bore of the housing with the chambers behind the rams so that well fluid in the bore urges the rams closed, means including a passageway in at least one ram for connecting the chamber behind it with the bore of the housing above the closed rams, and means on the rod connected to the one ram for closing the passageway upon inward movement of the rod with respect to the ram and opening the passageway upon outward movement of the rod with respect thereto.

5. A preventer of the character defined in claim 4, wherein the means on the rod for closing the passageway includes an annular packing engageable with the ram in surrounding relation to the outer end of the passageway so as to transmit inward movement of the rod to the ram.

6. A blowout preventer, comprising a housing having a bore therethrough and chambers therein which intersect opposite sides of the bore, rams reciprocable within the chambers between outer positions to open the bore and inner positions sealably engaged with one another and the chambers to close the bore, and means for moving each of said rams between its opened and closed positions, including an axially reciprocable rod extending into the ram chamber, and means connecting the rod to the ram for limited axial movement with respect thereto, said connecting means comprising a pair of slots extending upwardly from the bottom of the ram, on opposite sides of its axis of reciprocation, a pair of pins on the inner of the rod, and a bearing ring fitting closely about each pin for relative axial movement with respect thereto, said rings having inner and outer sides adapted to fit closely within inner and outer sides of the slot to permit the ram to be lowered into or raised from connection with the rod when the rod is in its outer axial position with respect to said ram, and the inner sides of the slot in said ram being recessed to receive the inner ends of the pins upon movement of the rod to its inner axial positions with respect to said ram.

7. A preventer of the character defined in claim 6, wherein each pin has a shoulder engageable with a shoulder on the bearing ring thereabout, when the rod is moved to its outer axial position with respect to the ram, in order to transmit outward movement of the rod to the ram.

8. A preventer of the character defined in claim 6, wherein the rod has means thereon engageable with the ram, as the rod is moved to its inner axial position, in order to transmit inward movement of the rod to the ram.

9. A preventer of the character defined in claim 6, including means connecting the bore of the housing with the chambers behind the rams so that well fluid in the bore urges the rams closed, means including a passageway in at least one ram for connecting the chamber behind it with the bore of the housing above the closed rams, and means on the rod connected to the one ram for closing the passageway upon inward movement of the rod with respect to the ram and opening the passageway upon outward movement of the rod with respect thereto.

10. A preventer of the character defined in claim 9, wherein the means on the rod for closing the passageway includes an annular packing engageable with the ram in surrounding relation to the outer end of the passageway so as to transmit inward movement of the rod to the ram.

11. Valve apparatus, comprising a body having a flowway therethrough and a chamber therein which intersects the flowway, a closure member reciprocable within the chamber between an outer position to open the flowway and an inner position to close the flowway, means for moving the closure member between its opened and closed positions, including an axially reciprocable rod extending into the chamber, and means connecting the rod to the closure member for limited axial movement with respect thereto comprising a slot extending upwardly from the bottom of the closure member, a pin on the inner end of the rod, and a bearing ring fitting closely about the inner end of the pin to permit relative axial movement between them, said ring having inner and outer sides adapted to fit closely within inner and outer sides of the slot to permit the closure member to be lowered into or raised from connection with the rod when the rod is in its outer axial position with respect to the closure member, and the inner side of the slot in the closure member being recessed to receive the end of the pin upon movement of the rod to its inner axial position with respect to the closure member.

12. Valve apparatus of the character defined in claim 11, wherein the inner end of the pin has a shoulder engageable with a shoulder on the bearing ring, when the rod is moved to its outer axial position, with respect to the ring, in order to transmit outward movement of the rod to the closure member.

13. Valve apparatus of the character defined in claim 11, wherein the rod has means thereon engageable with the closure member, as the rod is moved with the ram to its inner positions, in order to transmit inward movement of the rod to the closure member.

14. Valve apparatus of the character defined in claim 11, including means connecting the bore of the body with the chambers behind the closure member so that fluid in the flowway urges it closed, means including a passageway in at least one closure member for connecting the chamber behind it with the body flowway above the closed closure member, and means on the rod connected to the closure member for closing the passageway upon inward movement of the rod with respect to the closure member and opening the passageway upon outward movement of the rod with respect thereto.

15. A preventer of the character defined in claim 14, wherein the means on the rod for closing the passageway includes an annular packing engageable with the closure member in surrounding relation to the outer end of the passageway so as to transmit inward movement of the rod to the closure member.

16. Valve apparatus, comprising a body having a flowway therethrough and a chamber therein which intersects the flowway, a closure member reciprocable within the chamber between an outer position to open the flowway and an inner position to close the flowway, and means for moving the closure member between its opened and closed positions, including an axially reciprocable rod extending into the chamber, and means connecting the rod to the closure member for limited axial movement with respect thereto, said connecting means comprising a pair of slots extending upwardly from the bottom of the closure member, on opposite sides of its axis of reciprocation, a pair of pins at the inner end of the rod, a bearing ring fitting closely about each pin to permit relative axial movement between them, said rings having inner and outer sides adapted to fit closely within inner and outer sides of the slot to permit the closure member to be lowered into or raised from connection with the rod when the rod is in its outer axial position with respect to the closure member, and inner side of the slot in the closure member being recessed to receive ends of the pins upon movement of the rod to inner axial positions with respect to the closure member.

17. Valve apparatus of the character defined in claim 16, wherein each pin has a shoulder engageable with a shoulder on the bearing ring thereabout, when the rod is moved to its outer axial position, in order to transmit outward movement of the rod to the closure member.

18. Valve apparatus of the character defined in claim 16, wherein the rod has means thereon engageable with the closure member, as the rod is moved to its inner positions, in order to transmit inward movement of the rod to the closure member.

19. Valve apparatus of the character defined in claim 16, including means connecting the flowway of the body with the chamber behind the closure member so that fluid in the flowway urges it closed, means including a passageway in the closure member for connecting the chamber behind it with the body flowway above the closed closure member, and means on the rod connected to the closure member for closing the passageway upon inward movement of the rod with respect to the closure member and opening the passageway upon outward movement of the rod with respect thereto.

20. Valve apparatus of the character defined in claim 19, wherein the means on the rod for closing the passageway includes an annular packing engageable with the closure member in surrounding relation to the outer end of the passageway so as to transmit inward movement of the rod to the closure member.

21. For use in a blowout preventer having a housing with a bore therethrough, chambers therein intersecting opposite sides of the bore, and means including an axially reciprocable rod extending into each chamber for moving a ram therein between positions opening and closing the bore; a ram comprising a ram body adapted for axial reciprocation within a chamber toward and away from the ram body of another ram reciprocable within the other chamber, means on the ram body to form a continuous seal with respect to the other ram body and with respect to the chamber as the rams move into engagement with one another to close the bore, and means by which the ram body may be releasably connected to the axially reciprocating rod for limited axial movement with respect thereto and for support against sagging regardless of the axial position of the ram body with respect to the rod, including a slot extending upwardly from the bottom of the ram body, and a recess formed in said ram body on the inner side of and generally opposite the upper end of the slot.

22. A ram of the character defined in claim 11, wherein the ram body has a passageway opening at one end to its outer end.

23. A ram of the character defined in claim 21, wherein a pair of slots extend upwardly from the ram body on opposite sides of the axis of reciprocation, and a pair of recesses formed in said body each generally opposite the upper end of one of the slots.

24. In an operating system for moving the rams of a blowout preventer within guideways intersecting opposite sides of a bore through a central body of the housing of the preventer between positions opening and closing the bore; apparatus comprising a bonnet having a chamber on its inner end adapted to be removably connected across a guideway and a cylinder therein outwardly of the chamber, a piston axially reciprocable within the cylinder, a rod connected to the piston for reciprocation therewith and extending from the cylinder into the chamber, the inner end of said rod having a laterally extending head, a pair of pins extending inwardly from the head on opposite sides of the axis of reciprocation of the rod, and a bearing ring fitting closely about each pin for axial movement with respect thereto between an outer position in which the end of the pin is essentially flush with a bearing surface on the inner side of the ring and an inner position in which the end of the pin projects inwardly of said inner bearing surface.

25. An operating system of the character defined in claim 24, including an annular packing on the head intermediate the pins.

26. An operating system of the character defined in claim 25, wherein the rod has a hole therethrough whose inner end opens within the packing and whose outer end opens to a balance chamber in the bonnet outwardly of the cylinder.

27. An operating system of the character defined in claim 24, wherein each pin has a shoulder engageable with a shoulder on the bearing ring in its inner position.

* * * * *

UNITED STATES PATENT AND TRADEMARK OFFICE

CERTIFICATE OF CORRECTION

PATENT NO. : 4,488,703

DATED : December 18, 1984

INVENTOR(S) : Marvin R. Jones

It is certified that error appears in the above-identified patent and that said Letters Patent are hereby corrected as shown below:

On the title page;

Assignee: "Marvin R. Jones, Houston, Tex." should read --Koomey Blowout Preventers, Inc.

Signed and Sealed this

*Twenty-ninth* Day of *October 1985*

[SEAL]

*Attest:*

DONALD J. QUIGG

*Attesting Officer*

*Commissioner of Patents and Trademarks—Designate*